US006295437B1

(12) United States Patent
Hodoshima et al.

(10) Patent No.: US 6,295,437 B1
(45) Date of Patent: Sep. 25, 2001

(54) APPARATUS AND METHOD FOR FORMING AN IMAGE USING A DEVELOPING DEVICE CAPABLE OF OBTAINING A HIGH QUALITY IMAGE

(75) Inventors: Takashi Hodoshima, Kawasaki; Katsuhiro Aoki; Jun-ichi Matsumoto, both of Yokohama, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/472,867

(22) Filed: Dec. 28, 1999

(30) Foreign Application Priority Data

Dec. 28, 1998 (JP) ..... 10-373816
Jan. 20, 1999 (JP) ..... 11-011380
Jan. 29, 1999 (JP) ..... 11-021102

(51) Int. Cl.[7] ..... G03G 21/00; G03G 15/00
(52) U.S. Cl. ..... 399/346; 399/159
(58) Field of Search ..... 399/346, 71, 159, 399/162, 343, 350, 352, 353

(56) References Cited

U.S. PATENT DOCUMENTS 5,559,593 * 9/1996 Yoshinaga et al. ..... 355/296
5,812,919 * 9/1998 Takano et al. ..... 399/312
5,815,784 9/1998 Kasahara et al. .
5,953,567 9/1999 Muramatsu et al. .
5,987,298 11/1999 Muramatsu et al. .
6,014,532 * 1/2000 Takeichi et al. ..... 399/71
6,060,205 * 5/2000 Takeichi et al. ..... 430/126

FOREIGN PATENT DOCUMENTS

06332215 A 12/1994 (JP) .
09073229 A 3/1997 (JP) .
09274364 A 10/1997 (JP) .

* cited by examiner

*Primary Examiner*—Sandra Brase
(74) *Attorney, Agent, or Firm*—Oblon, Spivak, McClelland, Maier & Neustadt, P.C.

(57) ABSTRACT

An image forming apparatus includes a latent image bearing member to bear an electrostatic latent image, and a developer bearing member to bear a developer, in which the electrostatic latent image is formed on the latent image bearing member by first uniformly charging the latent image bearing member and then by performing an optical writing operation. The electrostatic latent image is visualized by supplying the developer borne on the developer bearing member to the latent image bearing member. A lubricant for reducing a friction coefficient of a surface of the latent image bearing member is supplied to the latent image bearing member and the lubricant has a charging polarity opposite to that of the developer. The friction coefficient of the latent image bearing member is maintained such that adhering of the developer to a background part of the latent image is prevented as a result of supplying the lubricant to the latent image bearing member. The lubricant, which includes a silicone resin, is supplied to the latent image bearing member such that the friction coefficient of the surface of the latent image bearing member is from about 0.1 to about 0.4. The friction coefficient of the surface of the latent image bearing member is set such that a cleaning device to remove a residual developer on the surface of the latent image bearing member is prevented from being dragged by the latent image bearing member by decreasing a contact resistance between the cleaning device and the surface of the latent image bearing member.

27 Claims, 10 Drawing Sheets

APPARATUS AND METHOD FOR FORMING AN IMAGE USING A DEVELOPING DEVICE CAPABLE OF OBTAINING A HIGH QUALITY IMAGE

CROSS REFERENCE TO RELATED APPLICATIONS

This document claims priority and contains subject matter related to Japanese Patent Applications Nos. JPAP10-373816, JPAP11-011380, and JPAP11-021102, filed on Dec. 28, 1998, Jan. 20, 1999, and Jan. 29, 1999, respectively, the entire contents of which are incorporated herein by reference.

BACKGROUND OF THE INVENTION

1. Field of the Invention

The present invention relates to image forming apparatuses, such as printers, facsimiles, copiers, and the like, and more particularly relates to an image forming apparatus and method for forming an image using a developing device adopting a contact developing system to develop an electrostatic latent image formed on a latent image bearing member, 2. Discussion of the Background In an image forming apparatus using an electrophotography, a latent image bearing member is generally formed of a photoconductor and an optical writing operation to form an electrostatic latent image on a uniformly charged photoconductor using a laser light. The electrostatic latent image on the photoconductor is developed by developer. The developed visible image is transferred to a recording medium, such as a recording paper, and then a residual developer on the photoconductor is removed by a cleaning device to prepare the photoconductor for a next charging process, The visible image on the recording medium is fixed thereto by a fixing device. An example of the cleaning device is known, in which residual developer that adheres on a surface of the photoconductor is scraped off by a cleaning blade that is in contact with a surface of the photoconductor.

When a friction coefficient of the surface of the photoconductor is high, the cleaning blade may be dragged by a friction between the surface of the photoconductor and the cleaning blade and therefor the tip end of the cleaning blade contacting the surface of the photoconductor may be turned over in a moving direction of the surface of the photoconductor. Accordingly, a lubricant is applied to the surface of the photoconductor to decrease the friction coefficient of the photoconductor as described in, for example, Japanese Laid-Open Patent Publication No. 8-254993.

The objects to apply the lubricant to the surface of the photoconductor are, in addition to the aforementioned decrease of the friction between the surfaces of the photoconductor and the cleaning blade, as follows:

1. decreasing abrasion of the photoconductor and the cleaning blade; and 2. decreasing a background fouling (adhering of tone to a non-image part of an image area) on the surface of the photoconductor.

As a developing method to visualize the electrostatic latent image on the photoconductor, there is known a contact developing system using component developer including only magnetizable toner or a non-magnetizable toner. In this developing method, such one component-developer is thin layered on a developing roller as a developer bearing member, and the toner is transferred onto the electrostatic latent image on the photoconductor by causing the developing roller to contact a surface of the photoconductor.

When such a contact developing method and the above-described method to supply lubricant to the surface of the photoconductor are combined, advantages including a less toner scattering phenomenon and a good reproduction property of an image can be obtained.

However, when the image is visualized with the above described two methods combined, the following problems occur. First, even when the supplying amount of the lubricant is usually controlled, some of the lubricant may be transferred to the developing roller that contacts the photoconductor. Therefore, this disturbs toner to be uniformly thin layered on the developing roller. Namely, when the lubricant is transferred to the developing roller, the adhering amount of the toner to the developing roller varies over an entire surface of the developing roller depending upon the amount of the transferred lubricant. A toner layer having a predetermined uniform thickness cannot be formed, for example, due to partial lack of the adhering amount of toner on the surface of the developing roller, or the toner may not adhere to the surface of the developing roller at all.

When a thin layer of toner having a predetermined thickness cannot be formed on the developing roller, or when toner does not adhere to the developing roller at all, an abnormal image, such as for example, an image with insufficient density or that including a blank spot may be formed.

Japanese Laid-Open Patent Publication No. 9-73229 also describes a developing method using a one-component developer borne on a developing roller forming a toner layer thereon. The developing roller contacts the photoconductor and the surface of the developing caller moves faster than that of the photoconductor so as to decrease the background fouling. The linear speed of the surface of the developing roller may be 1.2 to 3.0 times faster than that of the photoconductor, and more specifically is desired to be from 1.5 to 2.5 times faster than that of the photoconductor.

Further, Japanese Laid-Open Patent Publication No. 9-274364 describes a developing device that uses developer including a non-magnetizable toner, in which an additive is added to increase the fluidity of the developer, and the developer is borne on a developer bearing member. The developing device conveys the developer to a developing area opposed to a latent image bearing member (a photoconductor). In this developing device, the friction-charge property of the additive relative to the non-magnetizable toner (namely, a property to charge toner by the friction caused between the additive and the toner) is set so as to be approximately equal to that of the developer bearing member, or the friction-charge property of the non-magnetizable toner relative to the additive is greater than that of the developer bearing member relative to the additive.

Japanese Laid-Open Patent Publication No. 6-332215 describes an image forming method, in which a toner image formed on the latent image bearing member is transferred onto a recording medium and a coagulation rate of the toner is 30% or greater. The coagulation rate represents a degree of a coagulation of the toner, which is defined and measured by a measuring method, described, for example, in Japanese Laid-Open patent application No. 7-160033. In addition, the latent image bearing member described in Japanese Laid-Open Patent Publication No. 6-332215 is provided with a transfer-property improving layer at a surface of the latent image hearing member so as to prevent the transfer property from lowering due to using a toner of the relatively high coagulation rate.

In all of the above-described background image forming apparatus, because a photoconductor and a developing roller contact each other via a toner layer, the toner layer accepts a relatively strong electrostatic force caused between the photoconductor and the developing roller. Further, the developer is generally provided with one to three kinds of external additives so that the fluidity of the developer is increased and a good charging stability is realized. Further, the toner that is once moved to the photoconductor from the developing roller in a developing operation is moved back to the developing roller side in the area where the friction coefficient of the surface of the photoconductor is relatively low, for example 0.1 to 0.2 (Such a force to move the toner once moved to the photoconductor back to the developing roller is hereinafter called a scavenging force). This is because the surface of the photoconductor having a relatively low friction coefficient easily releases the toner when the photoconductor and the developing roller contact with each other via the toner layer. A developing performance is therefore lowered, particularly at a low image density area of an image, and a low-density image may appear. In addition, when the developing performance is increased by increasing a developing potential between the photoconductor and the developing roller, an incidence of the background fouling on the photoconductor tends to be increased and a general image quality may be lowered. Further, in the developing method of the above Japanese Laid-Open Patent Publication No. 9-73229, when linear speed of the developing roller is 1.2 times faster than that of the photoconductor, an abnormal image, such as moving toner to a trailing edge of a solid image, tends to occur.

In the developing method in Japanese Laid-Open Patent Publication No. 6-332215, because the coagulation rate of the toner is 30% or greater, a developing efficiency is lowered by coagulation of the toner.

In a contact developing system using non-magnetizable one-component developer, an electrostatic latent image formed on a latent image bearing member is developed by contacting an elastic developing roller with a charged toner layer formed thereon to the latent image bearing member. The density and quality of the developed image on the latent image bearing member is significantly affected by the thickness of a toner layer on the elastic developing roller. Background fouling tends to occur when the toner layer is thick, or a sufficient image density cannot be obtained when the toner layer is thin. Consequently, it has been difficult to obtain both clearness and high image density a developed image. Although a developer limiting member, such as a blade, may be provided to the elastic developing roller so that the thickness of the toner layer is limited, it is difficult to appropriately limit the thickness of the toner layer on the developing roller by the blade or the like, and there has been a problem that a supplying amount of the toner to the elastic developing roller is unstable.

Japanese Laid-Open Patent Publication No. 9-73229 describes a developing method of electrophotography, in which the bulk density of a toner layer on an elastic developing roller is 0.35 to 0.55 g/m$^3$ and the amount of the toner is 0.5 to 0.8 mg/cm$^2$. A thin toner layer is formed on the developing roller by limiting the thickness of the toner layer by a developer limiting member. The elastic developing roller contacts a photoconductor so as to develop an electrostatic latent image formed thereupon.

It may be possible to stably supply an appropriate amount of toner to the photoconductor by controlling the bulk density of the thin toner layer on the developing roller and the amount of toner in the toner layer as described in the aforementioned background art. However, the toner may adhere to a surface of the photoconductor not only by electrostatic force but also by non-electrostatic force, which often results in significantly increasing of background fouling. This is because the photoconductor and the developing roller contact each other via a toner layer. In addition, in such a contact developing system, dimension inaccuracy of the diameter of a developing roller affects the image quality. That is, when a contacting condition of the developing roller to a photoconductor is set according to a distance between the shafts of the photoconductor and the developing roller, and if a circularity of the developing roller is not uniform, a contact pressure of the developing roller to the photoconductor varies during one rotation of the developing roller, resulting in an unevenness of the image density.

In order to avoid such unevenness of the image density caused by nonuniform circularity of the developing roller, the contact pressure may be increased when a process condition, e.g., a developing bias, a distance between the developing roller and the photoconductor, and the like is set. However, if the contact pressure of the developing roller and the photoconductor is increased, a load of the developing roller to be driven increases, and an abnormal image including stripes may be caused by an unevenness of the rotation speed of the developing roller.

SUMMARY OF THE INVENTION

The present invention has been made in view of the above-discussed problems and an object of the invention is to address and resolve these and other problems. A nonexhaustive description of the features and attributes of the invention is presented in this section, with a more complete description provided by the figures and description of the preferred embodiment section of this document.

A feature of the present invention is a novel apparatus and method for forming an image using a developing device capable of obtaining a high quality image such as a copier, printer, fax printer or the like.

Preferred embodiments of the present invention provide a novel image forming apparatus, including a latent image bearing member to bear an electrostatic latent image, and a developer bearing member to bear a developer, in which the electrostatic latent image is formed on the latent image bearing member by first uniformly charging the latent image bearing member and then by performing an optical writing operation, and the electrostatic latent image is visualized by supplying the developer borne on the developer bearing member to the latent image bearing member, and in which a lubricant for reducing a friction coefficient of a surface of the latent image bearing member is supplied to the latent image bearing member and the lubricant has a charging polarity opposite to that of the developer.

The preferred embodiments further provide an image forming apparatus in which the friction coefficient of the latent image bearing member is maintained such that adhering of the developer to a background part of the latent image is prevented as a result of supplying the lubricant to the latent image bearing member.

Further, the lubricant may be supplied to the latent image bearing member such that the friction coefficient of the surface of the latent image bearing member is from about 0.1 to about 0.4. According to the invention, the lubricant may include a silicone resin. According to the invention, the friction coefficient of the surface of the latent image bearing member is set such that a cleaning device to remove a residual developer on the surface of the latent image bearing member is prevented from being dragged by the latent image bearing member by decreasing a contact resistance between the cleaning device and the surface of the latent image bearing member.

Further, the latent image on the latent image bearing member is visualized by contacting the developer having the same polarity as the charged part of the latent image bearing member to a part of the latent image bearing member where the charge is decayed by the optical writing operation. According to the present invention, the developer may be a one-component developer.

According to the present invention, the lubricant may be applied to the latent image bearing member so an to decrease a friction coefficient of a surface of the latent image bearing member and at least one sort of additive is added to the developer. The at least one sort of additive that is added to the developer may have a charged polarity opposite to that of the lubricant existing on the surface of the latent image bearing member.

According to the present invention, the image forming apparatus may further include a developer supplying member to supply the developer to the developer bearing member by contacting the developer bearing member and rotating in either the same direction or a reverse direction relative to a rotating direction of the developer bearing member, in which a linear speed of a surface of the developer supplying member is from about 0.5 to about 1.5 times that of the developer bearing member, and in which an intruding amount of the developer supplying member to the developer bearing member or that of the developer bearing member to the developer supplying member, in from about 0.5 to about 1.5 mm.

According to the invention, the developer may include a toner having an average particle diameter of from about 3 to about 12 $\mu$m. Furthermore, a surface roughness of the developer bearing member may be made to be from about 13 to about 80% of a toner particle diameter of the developer.

The surface of the developer bearing member may be coated with a silicone coating material. Further, the surface of the developer bearing member may be coated with a Teflon coating material. Furthermore, the surface of the developer bearing member may be coated with a coating material and a thickness of a coated layer on the developer bearing member is from about 5 to about 50 $\mu$m.

According to the present invention, the image forming apparatus may further include a developer limiting member configured to limit a thickness of a layer of the developer borne on the developer bearing member, and a holder configured to hold the developer limiting member, in which a length of a part of the developer limiting member protruding from the holder is from about 10 to about 15 mm.

Further, a contact pressure of the developer limiting member to the developer bearing member may be from about 5 to about 250 g·f/cm.

According to the invention, the image forming apparatus may further include a pressing device configured to contact the developer bearing member to the latent image bearing member. Further, the pressing device may include a plurality of members to contact the developer bearing member to the latent image bearing member.

Furthermore, a lubricant may be applied to the latent image bearing member so as to decrease a friction coefficient of a surface of the latent image bearing member and at least two sorts of additives may be added to the developer, and in which one of the at least two sorts of additives that are added to the developer has a charged polarity opposite to that of the lubricant existing on a surface of the latent image bearing member and the other one of the at least two sorts of additive has the same charged polarity as that of the lubricant existing on the surface of the latent image bearing member, and an addition amount of the one of the at least two sorts of additive is two or more times an addition amount of the other one of the at least two sorts of additives by a surface area ratio.

According to the present invention, the developer bearing member is a developing roller in which at least a surface layer may be made of an elastic material.

Further, the pressing device includes more than one elastic member configured to press the developer bearing member to the latent image bearing member by applying either a pressing force or a pulling force to a plurality of portions of the developing unit. Furthermore, the elastic member may include rubber material having a hardness lower than that of the developer bearing member.

According to the present invention, the latent image bearing member is a photoconductor, and wherein a friction coefficient of the surface of the photoconductor is from about 0.1 to about 0.4.

According to the present invention, a novel method for forming an image with an image forming apparatus includes the steps of: uniformly charging a latent image bearing member having a surface with a friction coefficient of from about 0.1 to about 0.4; forming an electrostatic latent image on the latent image bearing member by performing an optical writing operation; forming a toner image by developing the electrostatic latent image on the latent image bearing member by contacting the latent image bearing member bearing the electrostatic latent image formed thereupon to a developer bearing member bearing a developer; and transferring the toner image to a recording medium, in which at least one sort of additive added to the developer has a charged polarity opposite to that of a lubricant existing on a surface of the image bearing member.

According to the invention, a novel developing device of an image forming apparatus forming an image on a latent image bearing member includes a developing unit further including a developer bearing member, a developer limiting member configured to limit a thickness of a surface layer of the developer on the developer bearing member, a developer supplying member configured to supply the developer to the developer bearing member, a one-component developer, and a pressing device configured to press the developer bearing member to the latent image bearing member so as to be contacted to each other at a constant pressure via the developing unit.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, in which.

DESCRIPTION OF THE PREFERRED EMBODIMENTS

Figure 1:
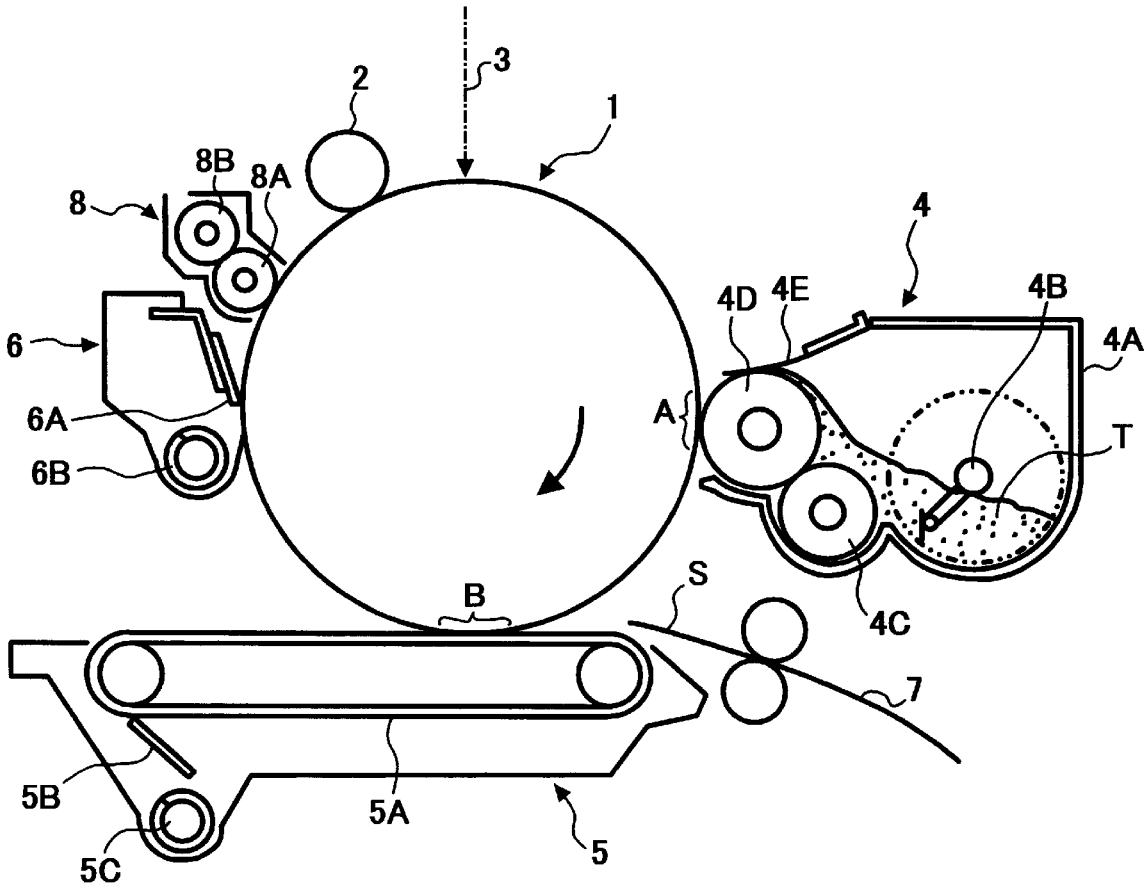
FIG. 1 is a schematic drawing illustrating a construction of a main part of an image forming apparatus according to the first embodiment of the present invention.

The preferred embodiments of the present invention are now described in detail referring to the drawings, wherein like reference numerals indicate identical or corresponding parts throughout the several views.

First Embodiment

FIG. 1 is a schematic drawing illustrating a main part of an image forming apparatus according to an embodiment of the present invention. The image forming apparatus includes a drum-shaped photoconductor 1 (hereinafter referred to as a photoconductor drum 1) as a latent image bearing member.

Around the photoconductor drum 1, a charging device 2, an optical writing device (only a light 3 is indicated by a dot-and-a-dash line), a developing device 4 to perform a visualizing process for an electrostatic latent image on the photoconductor drum 1, a transfer device 5, and a cleaning device 6 are respectively located to perform a process of electrophotography.

The electrostatic latent image is formed on a photoconductive layer on a surface of the photoconductor drum 1 by the optical writing device 3 that exposes and scans the photoconductor drum 1 after the photoconductor drum 1 is uniformly charged by the charging device 2, and the electrostatic latent image is visualized by developer (toner) supplied from the developing device 4.

A visualized image borne on the surface of the photoconductor drum 1 is transferred to a recording medium, such as a recording sheet S, which is fed from a sheet feeding device (in FIG. 1, numeral 7 represents a conveying path for the recording sheet S), and fixed to the recording medium by a fixing device (not shown).

In the first embodiment, the light 3 is irradiated by the optical writing device to the photoconductor drum 1 that is uniformly charged. A charge at a part of the uniformly charged photoconductor drum 1, which receives the light 3 from the optical writing device, decays. The developer supplied from the developing device 4 has the charge of the same polarity as that of the photoconductor drum 1 and therefore adheres to the part of the photoconductor drum 1 whose charge has decayed.

The developer used in the developing device 4 is a one-component developer (represented by a mark T) containing only a toner made of magnetizable or non-magnetizable material. The one-component developer is supplied to a surface of the developing roller 4D by a supplying roller 4C after being agitated by an agitator 4B that is disposed in a developing tank 4A of the developing device 4.

A layer of the one-component developer borne on the surface of the developing roller 4D is thinned so as to have an even thickness on the surface of the developing roller 4D by a toner-layer thinning blade 4E opposed to the developing roller 4D and supported at a part of the developing tank 4A.

When, for example, the magnetizable one-component developer is used in the developing device 4, the developing roller 4D bears the developer on the surface thereof by a magnetic force of a built-in magnet, and when the non-magnetizable one-component developer is used, the developing roller 4D bears the developer on the surface thereof by a known bearing method. In either case, the developing roller 4D can be rotated by the photoconductor drum 1 contacting the developing roller 4D at a developing nip portion indicated by a mark A in FIG. 1. Then, the one-component developer on the surface of the developing roller 4D adheres to a part of the photoconductor drum 1 where the electrostatic latent image is formed.

In this case, as well known, a developing bias is applied to the developing roller 4D so as to cause the one component developer to move to the photoconductor drum 1. However, because a part on the photoconductor drum 1, to which the optical writing operation is not performed, i.e., the part where the initial charge remains has the same polarity as that of the one-component developer, the developer does not adhere thereto. Thus, an image is developed by the developing device 4 using a one-component developer contact developing system.

The transfer device 5 includes a belt-shaped transfer member 5A movable around a pair of rollers that are rotatably supported by a housing of the transfer device 5. The belt-shaped transfer member 5A moves in the same moving direction as that of the surface of the photoconductor drum 1 opposed thereto. In the transfer device 5, a biasing device (not shown) is provided to electrostatically transfer the visible image onto a recording medium, such as the transfer sheet S, from the photoconductor drum 1.

The one-component developer that remains adhering to the belt-shaped transfer member 5A is scraped off by a cleaning blade 5B that contacts the belt-shaped transfer member 5A and reclaimed in a transfer side toner reclaim/conveying member 5C.

The cleaning device 6 includes a cleaning blade 6A that removes the one-component developer that remains on the photoconductor drum 1, and the removed one-component developer is reclaimed in a photoconductor side reclaim/conveying member 6B.

A lubricant applying device 8 is disposed between the cleaning device 6 and the charging device 2 along the surface of the photoconductor drum 1, and more specifically, the lubricant applying device 8 is disposed adjacent to the cleaning blade 6A mounted in the cleaning device 6.

The lubricant applying device 8 has a construction to carry lubricant stocked in a housing of the lubricant applying device 8 to an applying roller 8A through a supplying roller 8B, and to apply the lubricant onto the surface of the photoconductor drum 1.

An operation to supply the lubricant to the photoconductor drum 1 is controlled by switching between applying and not-applying the lubricant to the photoconductor drum 1, according to the density of the one-component developer that adheres to a background surface of the photoconductor drum 1, or the density of a visible image on the photoconductor drum 1, as disclosed in the above-described Laid-Open Patent Publication No. 8-254933.

With the above-described configuration, the lubricant can be constantly applied to the photoconductor drum 1 in a uniform applying amount, and thereby a turn over phenomenon of a leading edge of the cleaning blade 6A, abrasion of the cleaning blade 6A and the photoconductor drum 1 contacting each other and a background fouling that occurs at a blank area of the image on the photoconductor drum 1 can be suppressed to a certain degree but can not be completely suppressed. Therefore, in order to eliminate these malfunctions of the photoconductor drum 1, the applying amount of the lubricant is set so as to maintain a friction coefficient $\mu$ of the photoconductor drum 1 to satisfy the following formula:

$$0.1 \leqq \mu \leqq 0.4.$$

The lubricant that is supplied to the photoconductor drum 1 includes a particle made of silicone and has a charging property opposite to that of the one-component developer. That is, when the one-component developer has a negative charging polarity, the lubricant has a positive charging polarity. Thereby, the charged polarity of the lubricant becomes the same as that of the developing roller 4D that bears the one-component developer.

Accordingly, when the lubricant supplied to the photoconductor drum 1 moves to the developing roller 4D, the developing roller 4D repels the lubricant. Consequently, the lubricant does not adhere to the developing roller 4D, and a bearing amount of the one component developer on the developing roller 4D is therefore prevented from fluctuating.

As described above, the charged polarity of the lubricant may be opposite to the polarity of the one-component developer. However, the charged polarity of the lubricant can be alternatively set in relation to that of the photoconductor drum 1. That is, the charged polarity of the lubricant can be set opposite to that of the photoconductor drum 1.

When used in a digital type image forming apparatus, the photoconductor drum 1 includes a photoconductive layer, such as OPC (Organic Photo Conductor), which is charged to a negative polarity. Therefore, because the charging polarity of the one-component developer is the same as that of the photoconductor drum 1, the charging polarity of the developing roller 4D that bears the one-component developer is set opposite to that of the one-component developer. Consequently, the polarity of the lubricant becomes the same as that of the developing roller 4D and when the lubricant moves to the developing roller 4D, the developing roller 4D repels the lubricant and thereby the lubricant does not adhere to the developing roller 4D. The aforementioned lubricant may include, a particle made of silicone that has the positive polarity charging property.

In this embodiment, as described above, the charged polarity of the developing roller 4D that bears the one component developer and that of the lubricant is set to be the same by setting the charged polarity of charging property of the lubricant opposite to that of the photoconductor drum 1 having the same polarity as that of the one-component developer. Therefore, even when the lubricant moves to the developing roller 4D from the photoconductor drum 1, the developing roller 4D repels the lubricant. As a result, the lubricant does not adhere to the developing roller and only the one-component developer exists on the surface of the developing roller 4D. Accordingly, a thin layer of the one-component developer can be formed in a uniform thickness.

Although a drum-shaped photoconductor (photoconductor drum 1) is exemplary used as a latent image bearing member, the latent image bearing member is not limited to one having a drum shape and a belt-shaped photoconductor may be used in replacement for the photoconductor drum 1 in the present invention. In addition, the lubricant applying device may be configured not only with an applying roller having a plain surface but also with a rotatable brush roller. Further, as for the transfer device, a drum-shaped transfer member may be employed in replacement for the belt-shaped transfer member 5A.

Second Embodiment

Figure 2A:
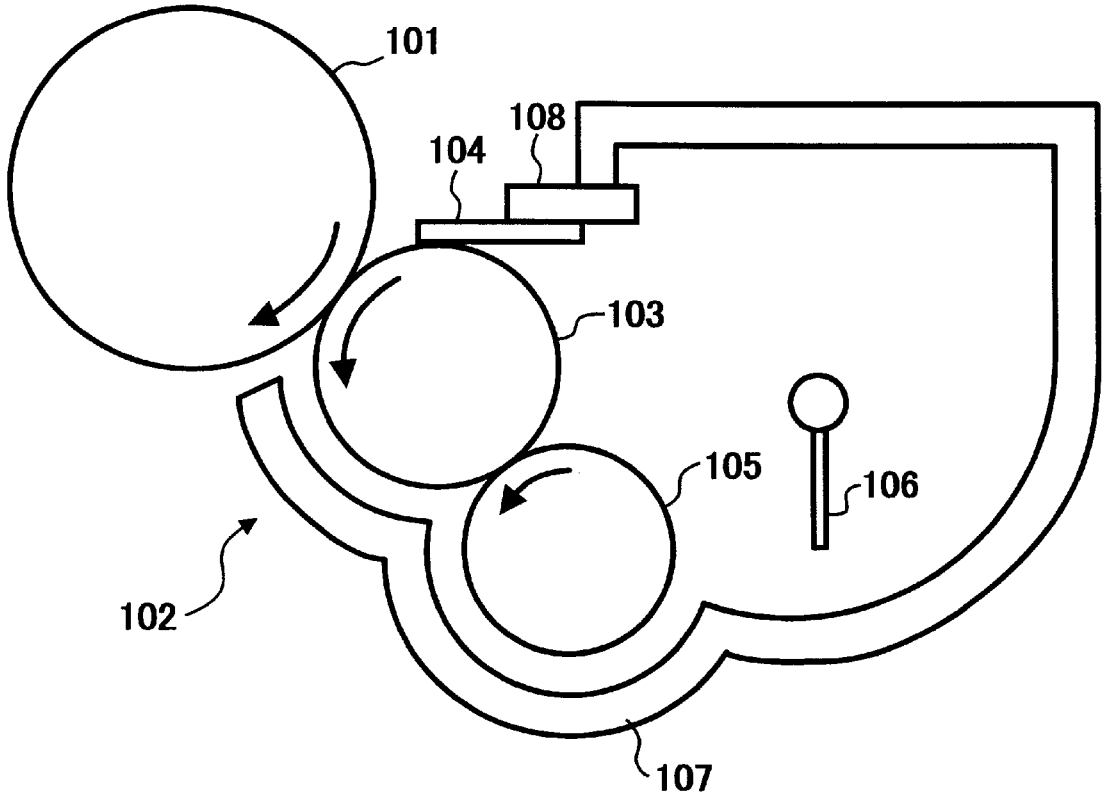
FIG. 2A is a schematic cross-section illustrating a developing device and a photoconductor of an image forming apparatus according to the second embodiment of the present invention.

FIG. 2A illustrates a schematic cross-section illustrating a developing device and a photoconductor of an image forming apparatus according to the second embodiment of the present invention. The image forming apparatus of the second embodiment adopts electrophotography. A photoconductor, such as for example a drum-shaped photoconductor 101, is used as a latent image bearing member. A belt-shaped photoconductor may be also used as the photoconductor 101, In addition, the present invention can be applied to an image forming apparatus in which an electrostatic latent image is formed on an image bearing member and developed by a method other than electrophotography.

The photoconductor 101 can be rotated by a known drive device and uniformly charged to a predetermined surface potential by a known charging device. An optical writing operation can be performed to the photoconductor 101 by a know optical writing device. Thus, the electrostatic latent image can be formed on the photoconductor 101. A known charging device, such as a corona charger or a charging roller, can be used in the aforementioned image forming apparatus. Also, a known laser writing device that irradiates the photoconductor 101 by converting an image signal into a light signal and that makes the photoconductor 101 exposed to the light signal can be used. Furthermore, a slit exposing device may be used, by which an original is illuminated with an illuminating device and a light reflected from the original is irradiated to the photoconductor 101 for the exposure.

The electrostatic latent image on the photoconductor 101 is developed with developer (toner) by a developing device 102 and the developed toner image on the photoconductor 101 can be transferred by a known transfer device to a recording medium, such as for example a transfer sheet and a transparent document sheet for OHP (over head projection) that is fed from a known sheet feeding device. The toner image on the photoconductor 101 is then fixed to the recording medium by a known fixing device. As for the above-described transfer device, known transfer members, such as a corona charger, a transfer roller, and a transfer/conveying device, may be used. In addition, the toner image on the photoconductor 101 may be transferred to an intermediate transfer member, and then the toner image on the intermediate transfer member may be transferred to a transfer sheet, an OHS, or the like, by a known transfer device. The photoconductor 101 can repeatedly be used after the toner image is transferred to the recording medium and the surface of the photoconductor 101 is cleaned by a known cleaning device.

The developing device 102 includes a developing roller 103 as a developer bearing member, a developer limiting blade 104 as a developer limiting member, a developer-supplying roller 105 as a developer supplying member, an agitator 106 as a developer agitating member, and a developer container 107, and a toner, for example, a one component developer is contained in the developer container 107.

The developing roller 103, the developer-supplying roller 105, and the agitator 106 are rotated by the drive section at a predetermined timing and a developing bias voltage is applied to the developing roller 103 from a power source.

The toner contained in the developer container 107 is mechanically supplied to the developer-supplying roller 105 after being agitated by the agitator 106 and is supplied to the developing roller 103 by the developer-supplying roller 105. The developer-supplying roller 105 is formed of polyurethane foam or the like and has flexibility. The developer-supplying roller 105 is provided with numerous concaved parts having a diameter of 50 μm to 500 μm on the surface thereof to hold the toner therein. Further, the developer-supplying roller 105 has a relatively low hardness, such as JIS A hardness 10° to 30° (JIS A hardness is defined in JIS K6301). Because the developer-supplying roller 103 has the surface having such a hardness relatively lower than that of the developer-bearing roller 105, the surface of the developer-supplying roller 105 can nonuniformly contact the surface of the developing roller 103 by being pressed by an appropriate pressure.

The rotating direction of the developer-supplying roller 105 is opposite to that of the developing roller 103 at the contacting part and the linear speeds of the developer-supplying roller 105 may be 0.9 times that of the developing roller 103 when the developer-supplying roller 105 rotates in the same direction as that of the developing roller 103 (counterclockwise in this example). A preferable linear speed of a moving surface of developer-supplying roller 105 is from 0.5 to 1.5 times that of a moving surface of developing roller 103.

Figure 2B:
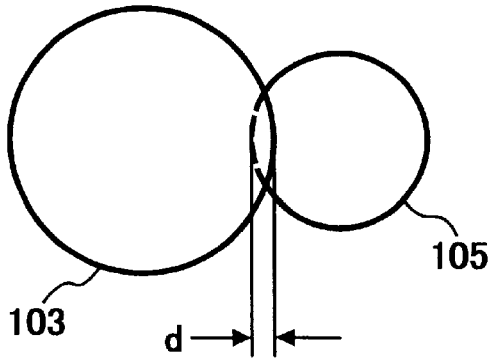
FIG. 2B is a schematic representation explaining an intruding amount of a developer-supplying roller to a developing roller.

In FIG. 2B, an intruding amount "d" of the developers supplying roller 105 to the developing roller 103 may be 0.5 to 1.5 mm. The intruding amount is a distance between a real contact point of the developer-supplying roller 105 with the developing roller 103 and an imaginarily drawn partial circle extending from a circle that represents the surface of the developer-supplying roller 105, as illustrated in FIG. 2B. The aforementioned rotating directions of the developer-supplying roller 105 and the developing roller 103, the ratio of linear speeds of the developer-supplying roller 105 to the developing roller 103, and the intruding amount "d" of the developer-supplying roller 105 to the developing roller 103 affect the charging property and toner supplying property of the developer-supplying roller 105. Accordingly, in order to obtain good charging property and toner supplying property, the rotating directions, the linear speeds, and the intruding amount of the developer-supplying roller 105 and the developing roller 103 must be appropriately determined.

Furthermore, the intruding amount of the developers supplying roller 105 to the developing roller 103 depends on a property of a motor and a gear head of the drive section that drives the developing roller 103. When the developing device 102 has an effective width of 240 mm for developing an A4 size image, requisite torque is 1.5 to 2.5 kgf·cm.

The toner contained in the developer container 107 includes one or more resins, such as polyester resins, polyol resins, styrene-acrylic resins, and the like resins. Further, a charge control agent (CCA) and a colorant are mixed with the resins. In addition, additives, such as silica, titanium oxide, or the like substance are added to the toner, such that the additives adhere to a surface of a toner particle. As the colorant, a carbon black, a phthalocyanine blue, a quinacrodone, carmine, or the like can be used. The function of the additives will be described later in relation to a charge amount of the additive that is added to the toner, a polarity of the additive, the including amount of the colorant in the toner, and the diameter of the toner particle.

A diameter of the additive is set so as to be from 0.1 to 1.5 μm. Further, in this embodiment, an average diameter of the toner is in a range of 3 to 12 μm, and, for example 7.5 μm, and accordingly, the toner can be applicable for developing an image with a high-resolution.

The developing roller 103 is preferably made of rubber material, and is formed with a diameter of from 10 to 30 mm. The surface of the developing roller 103 is appropriately made in a surface roughness of from 1 to 4 μm of JIS RZ standard, which corresponds to from 13 to 80% of the diameter of the toner particle. By thus setting the surface roughness of the developing roller 103, the toner can be held by the surface of the developing roller 103 and conveyed to the photoconductor 101 without being kept held by the surface of the developing roller 103.

Rubber material such as a silicone, a butadiene, an NBR, a hydrin, an EPDM and the like can be used for the developing roller 103. In addition, it is preferable to coat the surface of the developing roller 103 with coating material so that the quality of the developing roller surface can be kept constant even during elapse of time.

Silicone coating material and Teflon coating material are particularly suitable for such coating of the developing roller 103. The silicone coating material improves the charging property of the toner and the Teflon coating material improves a releasability of the toner from the developing roller 103. In addition, the coating material may appropriately include conductive material, such as carbon black or the like, to obtain conductivity. A preferable thickness of the coat layer is in a range of 5 to 50 μm and when the thickness exceeds 50 μm, shortcomings such as a crack and the like, tend to occur in the coat layer. The hardness of the developing roller 103 may be set to be relatively lower or higher than that of the photoconductor drum 1.

The toner (having, for example a negative charged polarity) that exists on the surface of the developer-supplying roller 105 (inside or outside of the concaved parts of the surface of the developing roller 105) is transferred and held by the developing roller 103 by an electrostatic force of a negative charge caused on the toner by being nipped between the developing roller 103 and the developer-supplying roller 105 (whose surfaces move in opposite directions to each other at a contact point thereof). Further, the toner is held on the surface of the developing roller 103 by the effect of the surface roughness thereof. However, the toner layer on the developing roller 103 is not uniform and sometimes an excessive amount of the toner may be held on the surface of the developing roller 103, for example, 1 $mg/cm^2$.

Therefore, the toner layer having a uniform layer thickness is formed on the surface of the developing roller 103 by contacting a developer limiting blade 104 to the developing roller 103. A tip end of the developer limiting blade 104 is directed in the rotating direction of the developing roller 103. The developer limiting blade 104 contacts the developing roller 103 at one side of the developer limiting blade 104. Alternatively, the direction of the developer limiting blade 104 may be directed opposite, i.e., opposite to the rotating direction of the developing roller 103, and an edge-contact construction in which an edge of the developer limiting blade 104 contacts the developing roller 104 can be adopted.

The developer limiting blade 104 may be made of metal, such as stainless steel SUS 304 with a thickness greater than 0.1 mm and less than 0.2 mm. Also, rubber material, such as for example a polyurethane rubber, or silicone resins, or fluorine-containing resin material whose charging property is opposite to the silicone, such as for example ETFE (Ethylene-tetrafluoroethylene copolymers) PTFE (polytetrafluoroethylene), PVDF (polyvinylidene fluoride), or the like having a thickness of 1 to 2 mm, and having relatively high hardness, may be used. In addition, because the developer limiting blade 104 made of material other than metal can be made low electric-resistant by mixing the carbon black or the like an electric field can be formed between the developing roller 103 and the developer limiting blade 104 by connecting a power source to supply a bias voltage to the developer limiting blade 104.

An illustrated in FIG. 2A, the developer limiting blade 104 is attached to the developer container 107 by a holder 108. A preferable protruding length of the developer limiting blade 104 from a tip end of the holder 108 is in a range of 10 to 15 mm. When the protruding length of the developer limiting blade 104 exceeds the upper limit of the range i.e., 15 mm, the size of the developing device 102 becomes excessively large and the developing device 102 cannot be compactly accommodated in a main body of the image forming apparatus. On the contrary, when the protruding length of the developer limiting blade 104 is less than the lower limit of the range i.e., 10 mm, a vibration of the developer limiting blade 104 tends to occur when the developing roller 103 rotates. Thereby, an abnormal image having, for example streaks in a lateral direction may be formed.

A preferable contact pressure of the developer limiting blade 104 to the developing roller 103 is in a range of 5 to 250 g·f/cm. When the contact pressure of the developer limiting blade 104 to the developing roller 103 exceeds the upper limit of the contact pressure range, i.e., 250 g·f/cm, the adhering amount of the toner to the developing roller 103 decreases and the charge amount of the toner excessively increases. Accordingly, the developing performance of the developing device 102 is lowered, resulting in lowering of the image density. On the contrary, when the contact pressure of the developer limiting blade 104 to the developing roller 103 is less than the lower limit of the aforementioned contact pressure range, i.e., 5 g·f/cm, the toner layer is not thin formed on the developing roller 103 and a coagulated toner may pass through the gap between the developer limiting blade 104 and the developing roller 103. Therefore, the image quality significantly deteriorates. In the embodiment, an appropriate adhering amount of the toner to the developing roller 103 was obtained, when a roller having a hardness of JIS A standard of 30° is used as the developing roller 103 and a plate of the stainless steel SUS 304 having a thickness of 0.1 mm is used as the developer limiting blade 104, and the contact pressure of the developer limiting blade 104 to the developing roller 103 is 60 g·f/cm.

Further, a preferable contact angle of the developer limiting blade 104 to the developing roller 103 is from 10° to 45° relative to a tangent line of the developing roller 103 when a tip end of the developer limiting blade 104 is directed to the rotating direction of the developing roller 103. With such a configuration of the developer limiting blade 104, a part of the toner adhering to the developing roller 103 is prevented from passing the nip between the developer limiting blade 104 and the developing roller 103 by the developer limiting blade 104 and thereby the thin toner layer having the toner amount from 0.4 to 0.8 mg/cm$^2$ is formed, and the toner charge amount is made to be within a range of −5 to −30 $\mu$C/g.

An inorganic or an organic photoconductor may be used for the photoconductor 101 and the surface friction coefficient of the photoconductor 101 is maintained in a range of 0.1 to 0.4. In order to maintain the surface friction coefficient of the photoconductor 101, a known method such as the one described in Japanese Laid-Open Patent Publication No. 4-372981 and the like may be used. This publication describes that when a toner having an average particle diameter from 4 to 10 $\mu$m is used, a substance that decreases a friction coefficient of the photoconductor is supplied to the photoconductor. For example, a lubricant may be directly applied to the photoconductor at a fixed interval, e.g., every time when a certain number of image transfer have been performed. Alternatively, a member that bears the lubricant may be brought into contact with the photoconductor continuously or every time when a certain number of image transfer have been performed.

Figure 3:
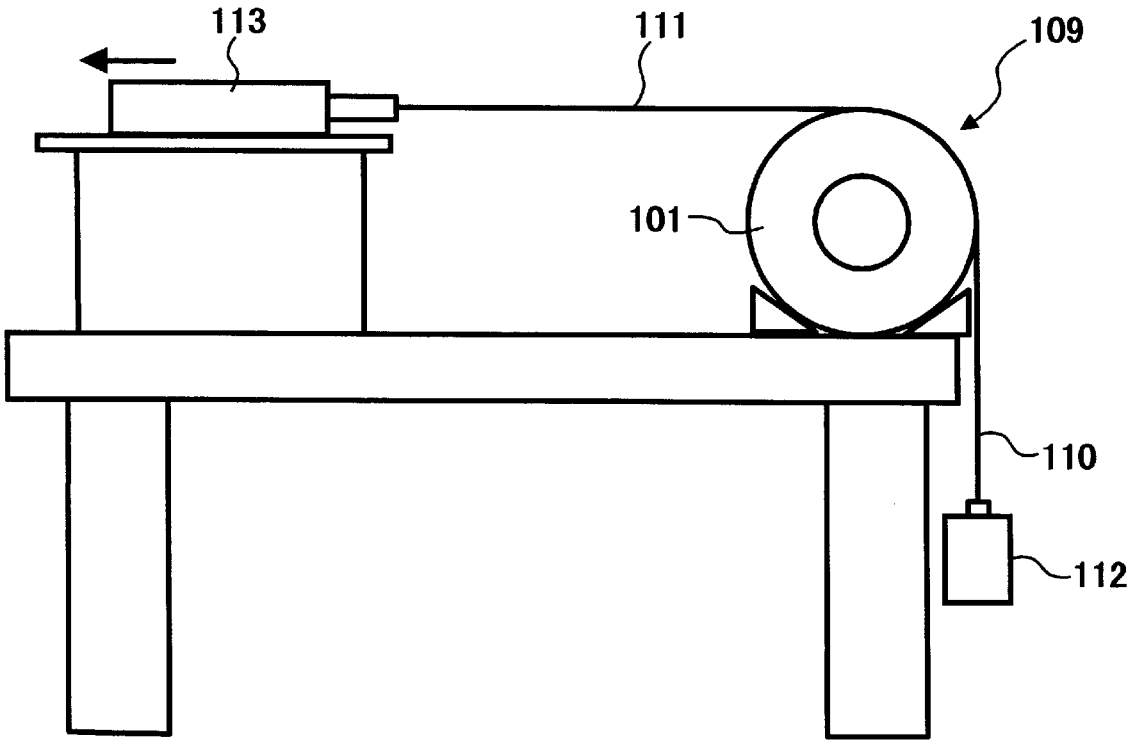
FIG. 3 is a schematic representation explaining a method of measuring a friction coefficient of the photoconductor.

The friction coefficient of the surface of the photoconductor 101 may be obtained by Eular method as described below and as illustrated in FIG. 3. First, a test sheet 109, which is a longitudinally textured A4 size paper sold under the name of TYPE 6200 and made by Ricoh Company, Limited, is cut into a rectangular shape of 297 by 30 (mm). The test sheet 109 is connected to threads 110 and 111 at both ends of the test sheet 109, respectively. The test sheet 109 is positioned around the photoconductor 101 and a weight 112 of 0.98 N (100 g) is attached to the thread 110. Another thread 111 is pulled by moving a digital force gage 113 in a direction indicated by an arrow and a value of the gage 113 is read when the test sheet 109 starts to move When the read value of the gage 113 is F(N), the friction coefficient $\mu$ of the surface of the photoconductor 101 is given by the following equation.

$$\mu = 1n(F/0.98)/(\pi/2)$$

where "1n" represents natural logarithm and "π" represents pi (Ludolphian number, about 3.14159), respectively.

A measurement value of the friction coefficient $\mu$ of the surface of the photoconductor 101 (hereinafter referred to as "measurement value") is from 0.4 to 0.6 when the lubricant, etc., is not applied to the surface of the photoconductor 101, as measured according to the Eular method. The measurement value tends to increase as time elapses. The measurement value indicates a low value from 0.1 to 0.4 when the lubricant is applied to the surface of the photoconductor 101.

The photoconductor 101 contacts the developing roller 103 via the toner layer on the developing roller 103. A preferable method to contact the photoconductor 101 and the developing roller 103 with each other by pressure is to use a spring as a pressing device. Particularly, an uneven contact of the photoconductor 101 with the developing roller 103 can be avoided when a plurality of springs are used. In addition, as the number of pressing devices increases, the uneven contact of the photoconductor 101 with the developing roller 103 can be decreased. A coil spring, a sheet spring, and the like may be used as the pressing device.

When the hardness of the developing roller 103 is 30° of JIS A standard, a preferable contact pressure of the developing roller 103 to the photoconductor 101 is in a range of 2 to 10 g·f/cm.

An influence of a contact pressure of the developing roller 103 to the photoconductor 101 on a developing property, such as for example an unevenness of a solid image and background fouling of an image will be explained below.

When the contact pressure of the developing roller 103 to the photoconductor 101 is less than the lower limit of an appropriate contact pressure range, a sufficient amount of the developer may not be moved to the surface of photoconductor 101 in a developing operation and thereby, the developing performance may fluctuate. Further, when the contact pressure of the developing roller 103 to the photoconductor 101 is greater than the upper limit of the appropriate contact pressure range, the toner that once adhered to the photoconductor 101 is moved back to the toner layer on the developing roller 103, or the toner remains on the developing roller 103. This is because a scavenging force to transfer the toner once moved to the photoconductor back to the developing roller increases and also the toner on the developing roller 103 is coagulated by being compressed by the developing roller 103.

Consequently, an abnormal image including, for example, an unevenness of the density of the solid image tends to occur. On the other hand, when the contact pressure of the developing roller 103 to the photoconductor 101 is in an appropriate range a good quality image having a uniform and high density can be produced.

A test result explaining an effect of additives externally added to toner (so as to adhere to a surface of a toner particle) on the image quality (specifically, the image density) is explained below in detail.

The test was performed with the photoconductor 101 having the diameter of 50 mm and the developing roller 103 having the diameter of 16 mm. Further, the friction coefficient $\mu$ of the surface of the photoconductor 101 was set in the range of greater than 0.1 to less than 0.4 as described before. A zinc stearate, a fluorine-containing material (PTFE or the like resin material), or the like is contained in a photoconductive layer of the photoconductor 101, or the same may be supplied to the surface of the photoconductor 101 by a brush, a blade, or the like from the outside (instead of being contained in the photoconductor 101) so as to decrease the friction coefficient $\mu$ of the surface of the photoconductor 101. In the above described materials, the fluorine-containing material is widely used in recent years. This is because the fluorine-containing material is superior in releasability and stability in various environment conditions and during the elapse of time. A pure fluorine is not preferable because the fluorine tends to be negatively charged due to the friction charging order relative to the opponent substance and positively charge an opponent substance to be contacted.

Because the developing device 102 performs a so-called negative-positive developing operation for the electrostatic latent image on the photoconductor 101 by making the polarity of the charged potential of the photoconductor 101 negative, the toner that is charged to the negative polarity when mixed with an additive was used. It is needless to say that a so-called positive-positive developing operation can also be performed. Basically, the charging property of the toner mostly depends on the results included in the toner and the charge control agent (CCA) that is mixed with the resins. However, the charging property of the toner is slightly influenced by additives that are externally added to the toner.

The function of the additive is to prevent coagulation of toner by decreasing coagulation rate of the toner such that a uniform developing performance and a uniform transferring performance are obtained. However, the charging property of the additive may disturb the aforementioned charging property of the toner. Therefore, when an electrostatic latent image on the photoconductor has a low potential and a developing electric field is relatively small, an influence of the charging property of the additive on the developing property must be considered.

A developing process is mainly performed by the effect of an electric field, formed by the electrostatic latent image on the photoconductor and a developing bias, or a charge of toner. In addition, a mechanical force to adhere the toner to the photoconductor and a scavenging force to move the toner once moved to the photoconductor back to the developing roller affect the toner in a developing operation.

In this embodiment, because the friction coefficient $\mu$ of the photoconductor 101 is relatively low, the mechanical adhering force between the toner and the photoconductor 101 is relatively small. Further, because the developing roller 103 contacts the photoconductor 101 via the toner borne thereon, the scavenging forge is relatively large. Accordingly, the toner once moved to the photoconductor 101 tends to move back to the developing roller 103 and the developing performance thereof is low.

When the developing performance is low as above and the electric field of the developing operation is relatively weak because an electrostatic latent image on the photoconductor 101 has a low potential, if the charged additives added to the toner electrostatically repel the charged lubricant, the developing performance may further be lowered resulting in low image density. Therefore, in order to prevent lowering of the image density, it is desired to prevent the charged additives added to the toner from electrostatically repelling the charged lubricant that exists on the surface of the photoconductor 101.

Two types of toner, "toner A" and "toner B" are used in the test. The "toner A", which is generally used in background developing devices, includes 0.4 wt % of silica and 0.6 wt % of titanium oxide, and the "toner B" used in the embodiment includes 0.2 wt % of silica and 0.9 wt % of titanium oxide. That is, while the weight ratio of titanium oxide to silica in the toner A is 1.5, the weight ratio of titanium oxide to silica in the toner B is 4.5, i.e., the weight ratio of titanium oxide to silica in the toner B is two times or more greater than that in the toner A.

The above weight ratio of titanium oxide to silica for the toner B is determined on the basis that the specific gravity of titanium oxide is greater than that of silica. In addition, for obtaining the same surface area of the particles of the titanium oxide as that of the silica, the amount of titanium oxide added must be nearly two times that of the silica. Accordingly, by making the weight ratio of titanium oxide to silica as above, a resultant surface area ratio of the titanium oxide to the silica in the toner A is presumed to be nearly 1:1.5.

Figure 6:
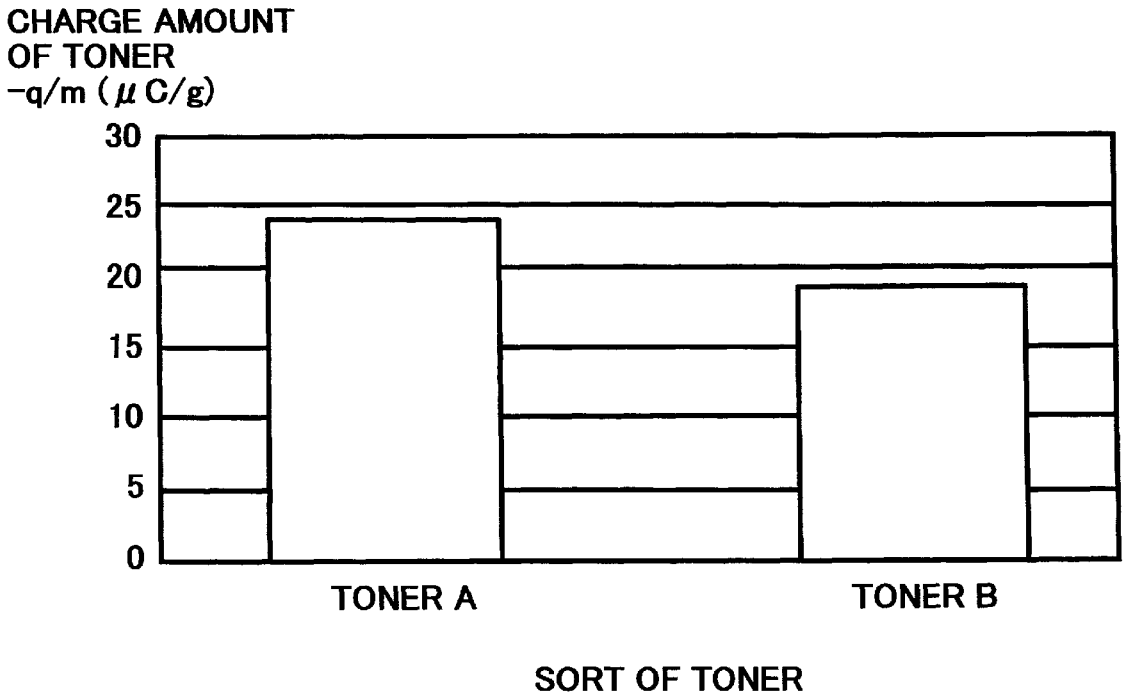
FIG. 6 is a graph illustrating a charge amount of toners A and B to which different amounts of additive are respectively added.

In the charged additives, silica is charged to the negative polarity and titanium oxide is charged to the positive polarity. Therefore, as the addition rate of the titanium oxide is increased, the charge amount of the toner tends to decrease under the influence of the titanium oxide. Therefore, an electrostatic repelling force of the additives to repel a charged lubricant on a surface of the photoconductor 101 can be decreased by changing the ratio of the addition amount of the additives. The charge amount of each of the toners A and B, to which different addition amounts of additives are respectively added, is indicated in FIG. 6.

Figure 4:
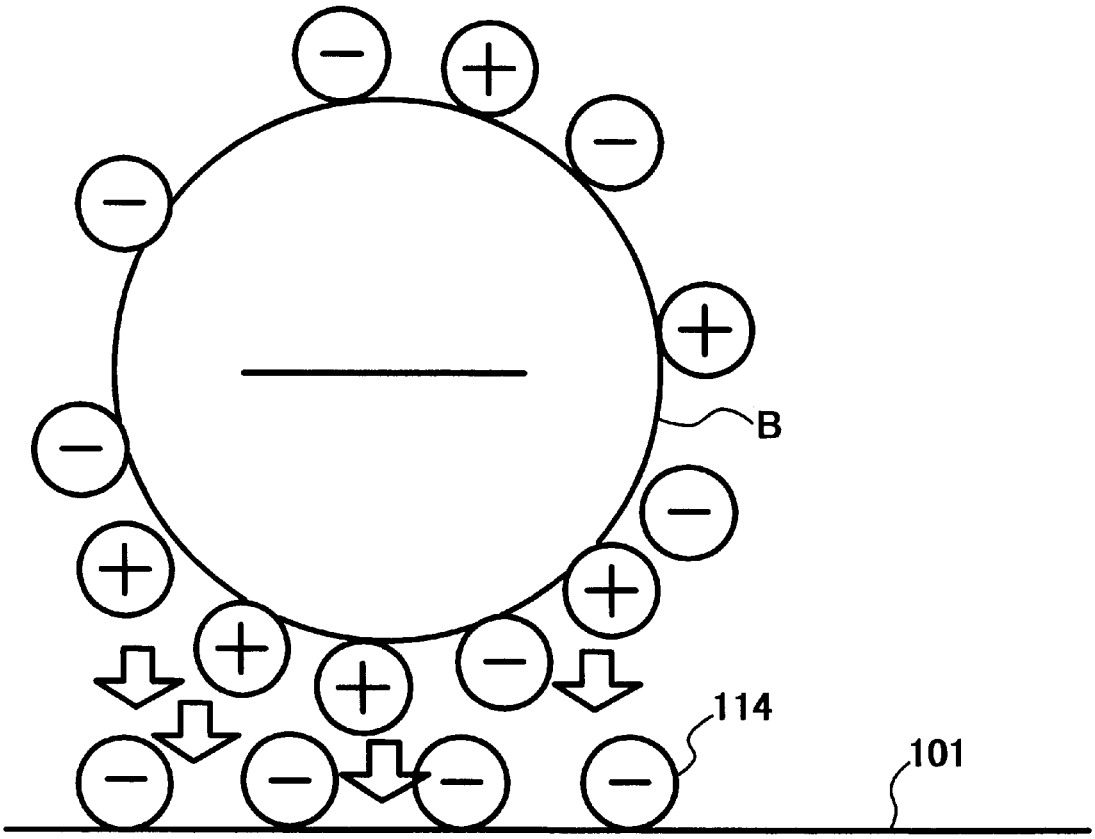
FIG. 4 is a microscopic diagram illustrating toner in the vicinity of the photoconductor.
Figure 5:
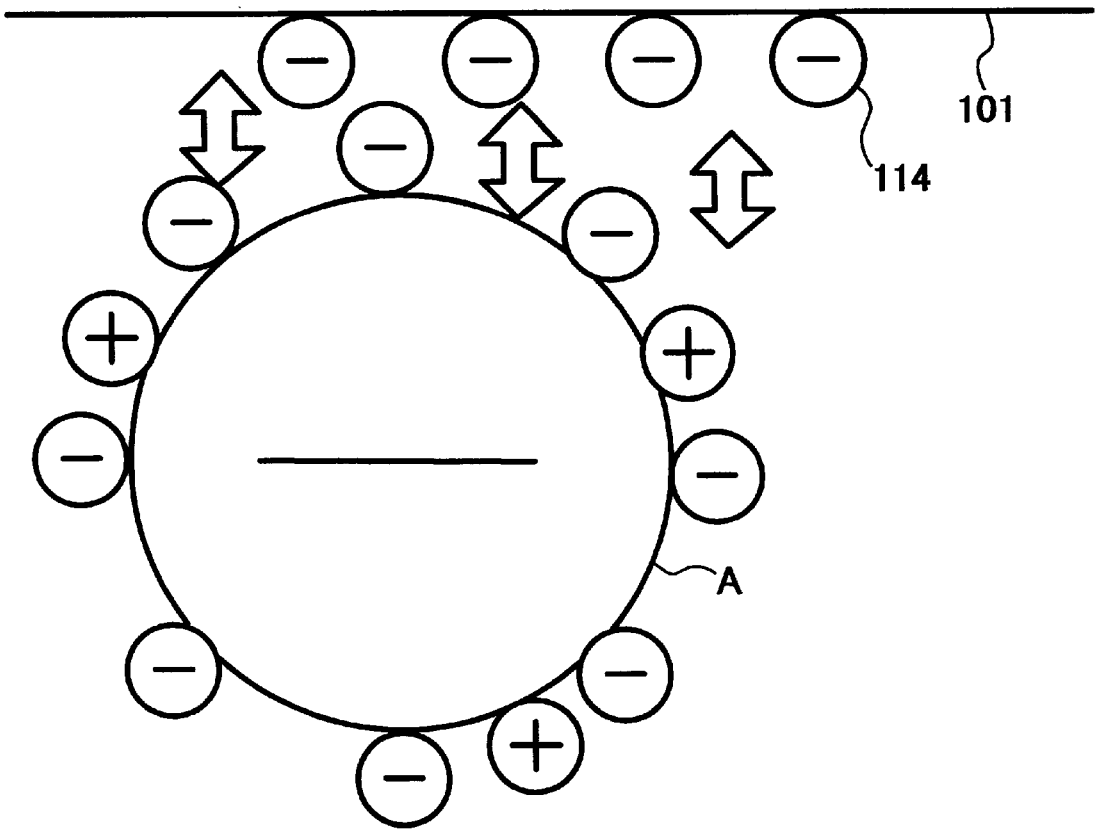
FIG. 5 is another microscopic diagram illustrating toner in the vicinity of the photoconductor.

As microscopically illustrated in FIG. 4, the additives of the toner B, which are positively charged, exist at a part closest to the electrostatic latent image 114 on the photoconductor 101. On the other hand, as illustrated in FIG. 5, the additives of the toner A which are negatively charged exist at a part closest to the electrostatic latent image 114. Therefore, the toner A is prone to be electrostatically repelled with negatively charged lubricant, for example, PTFE (polytetrafluoroethylene), which exists on the surface of the photoconductor 101, resulting in lowered developing performance.

Therefore, as can be understood from FIG. 4, more positively charged additives are present in the toner B than in the toner A, and thereby, the surface of the photoconductor 101 can be uniformly developed even when lubricant is present on the photoconductor 101. Thus, a uniform and high-density image can be obtained even from a low contrast original image by controlling the amount of each of silica and titanium oxide to be added to the toner.

Third Embodiment

The third embodiment of the present invention is described hereinbelow. The difference from the second embodiment is that a particle diameter D of the toner is set to satisfy the following formula:

$$4<D<6(\mu m)$$

The toner is made of the same materials as that of the second embodiment. The toner particle in the embodiment has a smaller diameter than that of known toners, which is generally 7 to 11 $\mu$m.

Generally, the smaller the diameter of the toner particle becomes, the closer the toner is brought to a surface of a photoconductor to which the toner is applied. Accordingly, electrostatic force and Van der Waals force between the toner and the photoconductor, which depends on the distance between the toner and the photoconductor, increases as the diameter of the toner particle becomes smaller causing various problems in developing, transferring, and cleaning processes. In addition, the toner once contacted with the photoconductor 101 remains at a non-image part of an image area on a surface of the photoconductor 101 resulting in an image background fouling. However, in this embodiment, the friction coefficient $\mu$ of the photoconductor 101 is set so as to be in a relatively low range of greater than 0.1 and less than 0.4. Therefore, the toner hardly remains on the surface of the photoconductor 101. The reason why the toner tends not to remain on the surface of the photoconductor 101 is that non-electrostatic adhering force, such as van der Waals force, between the toner and the surface of the photoconductor 101, is decreased as the friction effect of the photoconductor 101 is decreased. Namely, the toner that is located close to the surface of the photoconductor 101 is separated from the surface of the photoconductor 101 by the lubricant applied to the surface of the photoconductor 101.

Figure 7:
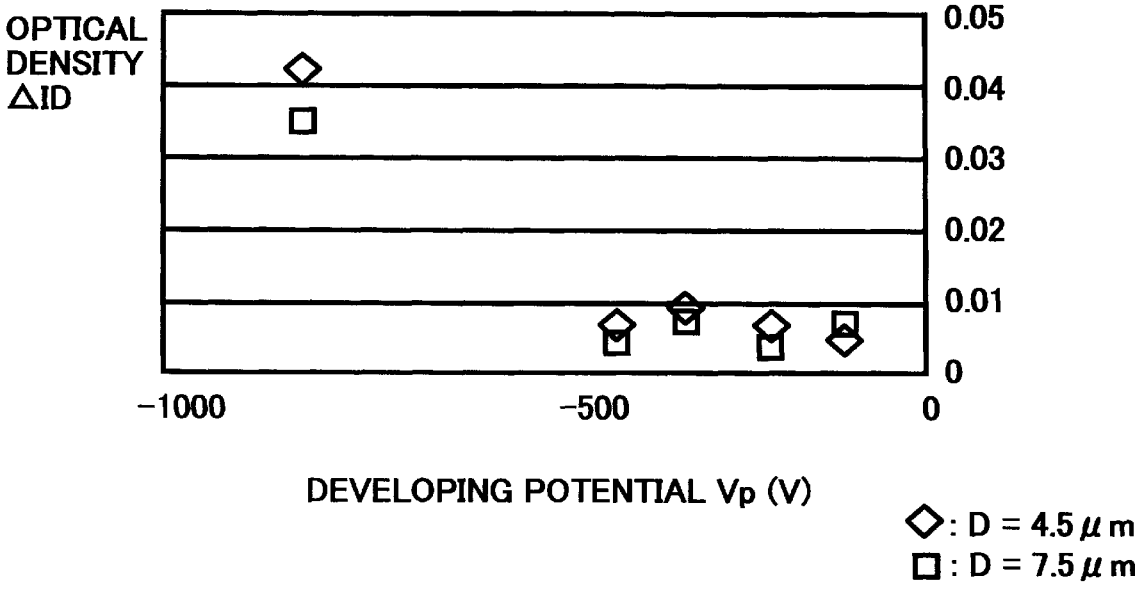
FIG. 7 is a graph illustrating a relationship between a developing potential Vp and an optical density ΔID in a film transfer test of developing toner.

FIG. 7 illustrates a property of the background fouling when the friction coefficient of the photoconductor 101 is decreased as described above. A horizontal axis represents a developing potential Vp (as the developing potential Vp increases, a developing amount of the toner charged to the negative polarity increases) and a vertical axis represents an optical density ΔID of a film transfer test of the toner using an adhesive tape and a plain paper. When the developing potential is set to −400 V and the optical density is 0.2 or less, there is no practical background fouling problem. In this condition, toners having particle diameters D of 4.5 and 7.5 $\mu$m, respectively, were tested, and there was no problem in either of the toners. In addition, it was found that even when the particle diameter D of the toner was further decreased to 4.0, little background fouling occurred.

In this embodiment, as described above, even when the particle of the toner is set to such a small diameter as from 4 to 6 $\mu$m, non-electrostatic adhering force of the photoconductor 101 to the toner can be decreased and the developing amount of the toner on the photoconductor 101 can be increased.

Fourth Embodiment

In the fourth embodiment of the present invention, the coagulation rate of the toner of the third embodiment is set to 15% or greater. The coagulation rate of the toner can be measured, for example, according to the method described in Japanese Laid-Open patent application No. 7-160033, including the following steps:

1. Preparing a combination of three sieves, having different mesh sizes;
2. Laying the three sieves one on top of another in the order of mesh size with the smallest sieve on the bottom;
3. Configuring each of the mesh sizes of sieves to 75 $\mu$m, 45 $\mu$m, and 22 $\mu$m, respectively;
4. Putting in 2 grams of the toner in the top sieve;
5. Vibrating the three sieves in an amplitude of 1 mm for a time period T calculated by the following formula;

$$T=20+(1.6-W)/0.016(\text{sec.}),$$

where "W" is a dynamic apparent specific gravity calculated by following formula;

$$W=(P-a)c/100+a,$$

where "P", "a", and "c" represent a tight apparent specific gravity, a loose apparent specific gravity, and a compression rate obtained from a ratio of the tight apparent specific gravity and the loose apparent specific gravity, respectively;

6. Measuring a weight of the toner remaining in each sieve after the three sieves are vibrated, and adding the measured value to the below formula so as to calculate the coagulation rate of the toner;

(1) $(Wt1/2)\times 100$ (2) $(Wt2/2)\times 100\times 3/5$ (3) $(Wt3/2)\times 100\times 1/5$ where Wt1, Wt2, and Wt3 represent weights of the remaining amount of the toner in the top, middle, and bottom sieves, respectively.

The aggregate amount of the above three values (1), (2), and (3), is defined as the coagulation rate of the toner.

In the above-mentioned third embodiment, when the friction coefficient $\mu$ of the photoconductor 101 is set so as to be from 0.2 to 1.0 and when a low contrast image, such as for example a one-dot image, is formed, the developing amount of the toner decreases and the image density may become low. The coagulation rate of the toner is 13% in the third embodiment.

However, in the fourth embodiment, the coagulation rate of the toner is set so as to be 15% or greater and thereby the toner moved to the photoconductor 101 is not crushed in the developing operation and thereby is prevented from being moved back from the photoconductor 101. In addition, the friction coefficient $\mu$ of the photoconductor 101 is set in the range of greater than 0.2 to less than 1.0 and thereby an image from an original of low contrast can be uniformly developed.

Fifth Embodiment

Figure 8:
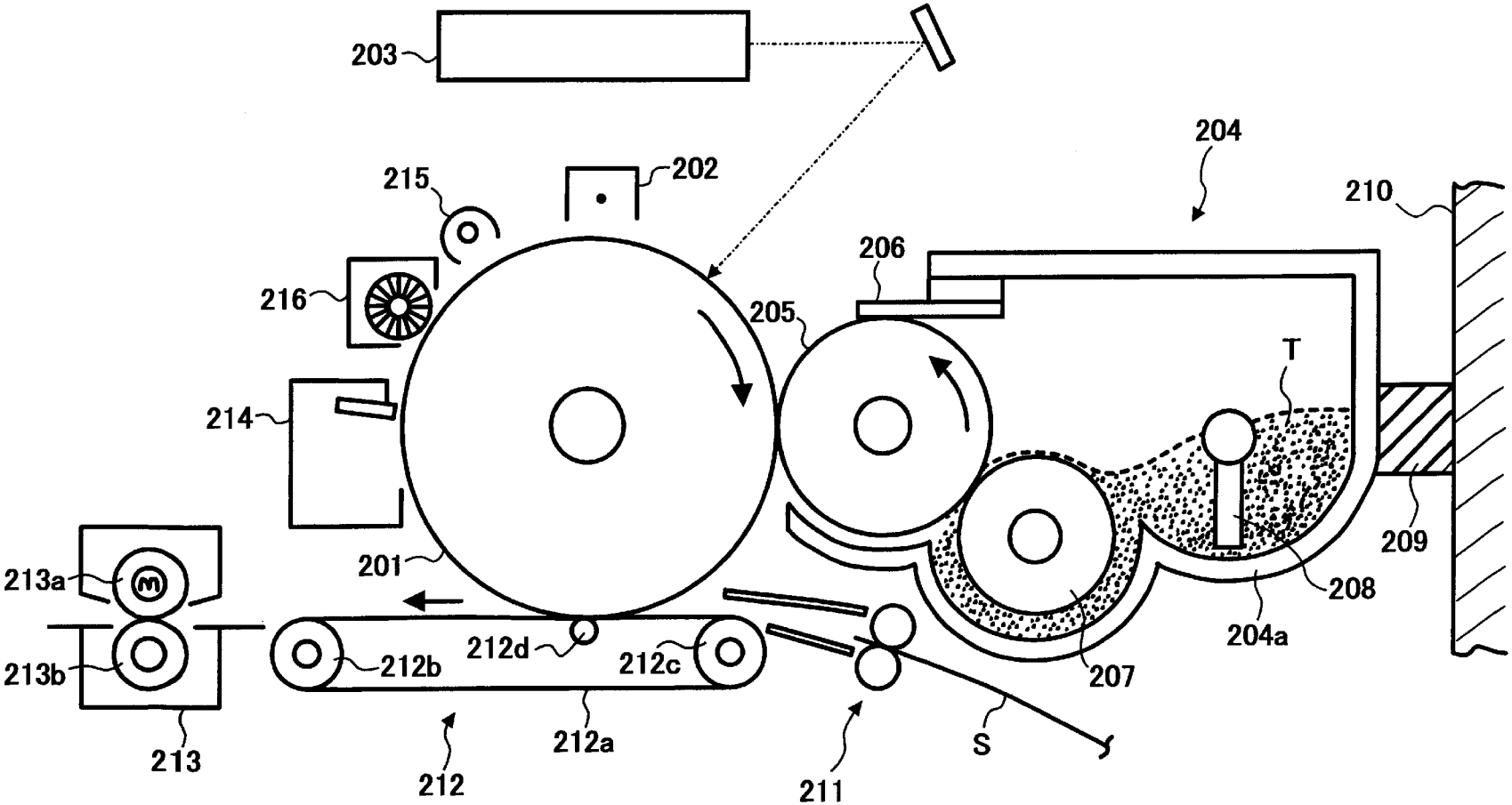
FIG. 8 is a schematic drawing illustrating a construction of an image forming apparatus according to the fifth embodiment of the present invention.
Figure 9:
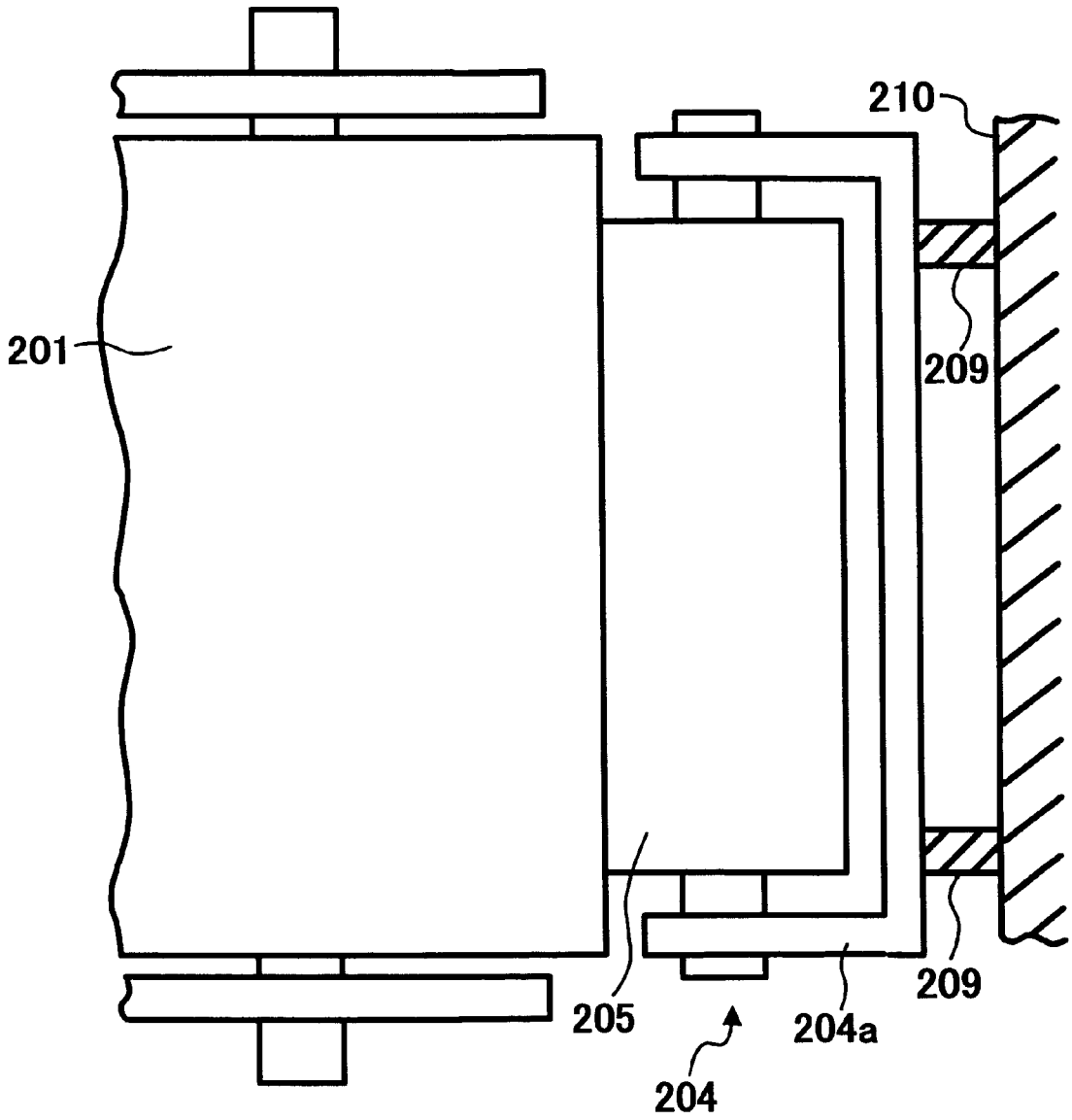
FIG. 9 is a schematic drawing illustrating a construction of a main part of a developing device of an image forming apparatus according to the sixth embodiment of the present invention, as viewed from upward.
Figure 10:
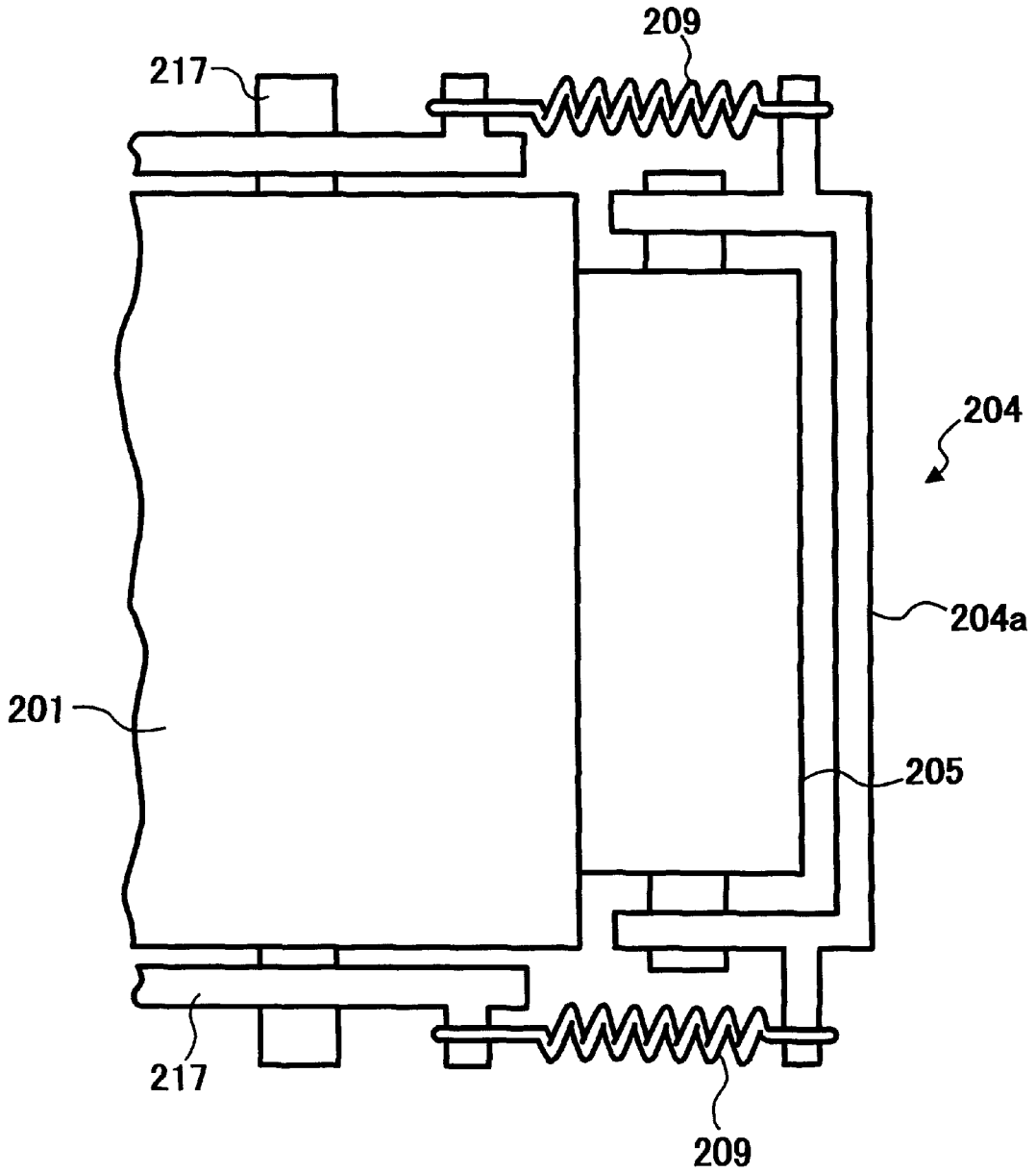
FIG. 10 is a schematic drawing illustrating a construction of a main part of a developing device of an image forming apparatus according to the seventh embodiment of the present invention, as viewed from upward.

A construction and operation of an image forming apparatus according to the fifth to seventh embodiments is described in detail referring to the FIGS. 8 to 10.

FIG. 8 is a schematic drawing illustrating an exemplary construction of an image forming apparatus according to the fifth embodiment of the present invention. The image forming apparatus adopts electrophotography and is applicable for printers, digital copying machines, and a printer section for facsimiles. The image forming apparatus includes a drum-shaped photoconductor 201 as a latent image bearing member, a charging device 202 that uniformly charges the photoconductor 201, and an electrostatic latent image forming device 203 that forms an electrostatic latent image on the charged photoconductor 201 by optically writing an image corresponding to image information. The image founding apparatus also includes a developing device 204 having a developing roller 205 as a developer bearing member that bears a toner T as a one component developer and visualizes the electrostatic latent image on the photoconductor 201 by performing a developing operation.

In addition, the image forming apparatus includes a transfer device 212 that transfers the visible toner image on the photoconductor 201 onto a recording medium, such as for example a recording sheet S, and a fixing device 213 that affixes the toner image onto the recording sheet S. Further, the image forming apparatus includes a cleaning device 214 that cleans the surface of the photoconductor 201 after the toner image is transferred, and a discharge device 215 that electrically discharges the surface of the photoconductor 201 after it is cleaned.

Furthermore, the image forming apparatus is provided with a pressing device 209 that includes a feature of the present invention and that presses the developing roller 205 to the photoconductor 201 so as to cause the developing roller 205 to contact the photoconductor 201 at constant pressure. In this embodiment, the diameter of the photoconductor 201 is set to 50 mm and that of the developing roller 205 is set to 16 mm.

The image forming apparatus forms a desired image on the recording sheet S by performing the image forming process, such as charging, optical writing, developing, transferring, and fixing processes. The image forming process to form the image is performed as described below in detail. An optical writing process is performed on the photoconductor 201 (which is uniformly charged before use by the charging device 202) by the electrostatic latent image forming device 203, according to the image information so as to form an electrostatic latent image. The developing roller 205 bears the toner T which is in contact with the photoconductor 201, then visualizes the electrostatic latent image with the toner T. The visible image is transferred to the recording sheet S, that is conveyed from a sheet feeding section (not shown) through a registration roller 211, and the toner image on the recording sheet S is affixed thereto by the fixing device 213. Thus, the image forming operation is completed.

Furthermore, the photoconductor 201 after the toner image is transferred is cleaned by removing a residual toner or the like by the cleaning device 214. Then the photoconductor 201 is electrically discharged by the discharge device 215. Thus, the photoconductor 201 is prepared for the next image forming operation.

Further, the developing roller 205 is pressed so as to contact the photoconductor 201 at constant pressure by the pressing device 209, which is made of an elastic material, when the aforementioned developing process is performed. As the photoconductor 201, an inorganic or organic photoconductor may be used and the friction coefficient $\mu$ of the photoconductor 201 is set so as to be from 0.1 to 0.4.

Next, a construction of each section of the image forming apparatus is explained. The developing device 204 uses a contact developing system that performs a contact developing operation to the photoconductor 201 with a developing roller 205 bearing the toner T. The developing device 204 includes the developing roller 205, a developer limiting blade 206 as a developer limiting member that limits a thickness of a layer of the toner T on the developing roller 205, a developer-supplying roller 207 as a developer-supplying member that supplies the toner T to the developing roller 205, an agitator 208 to agitate the toner T contained in the developing unit 204*a,* and the toner T in a developing unit 204*a*. Furthermore, the developing unit 204*a* of the developing device 204 is supported by a main body frame (not shown) of the image forming apparatus. The developing unit 204*a* is movably provided in the directions to cause the developing roller 205 to contact or separate from the photoconductor 201. Furthermore, the pressing device 209 includes one or a plurality of elastic members located, for example, between a rear side (right side in FIG. 8) of the developing unit 204*a* and the main body frame 210 of the image forming apparatus. The pressing device 209 is configured to press the developing roller 205 to the photoconductor 201 via the developing unit 204*a*. In addition, at least the surface layer of the developing roller 205 is made of an elastic material.

The charging device 202 illustrated in FIG. 8 is a non-contact type charging unit, such as for example a charger or the like. A charging roller, a charging brush, or like contact type charging apparatus may be also used. An optical writing device including a laser scanning optical system having, for example, a laser diode, a deflector, an imaging lens, or the like may be used as the electrostatic latent image forming device 203. Also, the optical writing device including a light emitting diode (LED) array, a liquid crystal shutter array, or the like may be also used. The transfer device 212 illustrated in FIG. 8 is a transfer belt unit including a transfer belt 212*a,* a drive roller 212*b* and a driven roller 212*c* that support the transfer belt 212*a,* a bias applying roller 212*d,* and the like. Known other types of transfer devices, such as for example a transfer roller, a transfer charger, or the like may be also used. Further, a fixing unit 213 including a heat roller 213*a* and a pressure roller 213*b* is used an a fixing device, however, the composition of the fixing device is not limited to the aforementioned composition.

Furthermore, the cleaning device 214 illustrated in FIG. 8 is a blade type cleaning unit. However, the cleaning device may be a cleaning unit including, for example a brush roller or the like. A discharge lamp or discharging charger may be used, for example, as the discharging device 215.

Furthermore, in the above image forming apparatus, a friction coefficient $\mu$ of the surface of the photoconductor 201 is in a range of 0.1 to 0.4 (as described later in detail) so that toner having an average particle diameter from 4 microns or greater to 10 microns or less can be used. In order to maintain the range of friction coefficient $\mu$, lubricant may be applied to a surface of the photoconductor 201, if necessary, and therefore, the image forming apparatus may be provided with a lubricant supplying device 216, if necessary. The lubricant supplying device 216 is provided at a downstream side of the cleaning device 214 in a photoconductor rotating direction. In addition, the lubricant supplying device 216 is made detachable from the image forming apparatus by an attaching/detaching device (not shown). The lubricant supplying device 216 is controlled to contact the photoconductor 201 to apply the lubricant to the surface of the photoconductor 201 as required and thereby the friction coefficient $\mu$ of the surface of the photoconductor 201 is kept in a certain range.

Other known lubricant supplying devices, such as the one employing a brush roller or a sponge roller that bears the lubricant, can be used. Also, a known lubricant supplying device that causes a solid lubricant to directly contact the photoconductor can be used. The lubricant may be directly applied to the photoconductor 201 at an interval of a certain number of image forming operations. Alternatively, as illustrated in FIG. 8, the lubricant may be supplied to the photoconductor 201 by continuously contacting a lubricant bearing member, such as a brush roller or the like of a lubricant supplying device 216 to the photoconductor 201, or by contacting the lubricant bearing member to the photoconductor 201 at an interval of a certain numbers of the image forming operation.

As a solid lubricant, for example, higher fatty acid, such an for example zinc stearate, barium stearate, lead stearate, iron stearate, nickel stearate, cobalt stearate, copper stearate, strontium stearate, calcium stearate, cadmium stearate, magnesium stearate, zinc oleate, manganese oleate, iron oleate, cobalt oleats, lead oleate, magnesium oleate, copper oleate, zinc palmitate, cobalt palmitate, copper palpitate, magnesium palmitate, aluminum palmitate, calcium palmitate, calcium palpitate, lead caprylate, lead caproate, zinc linoleate, cobalt linolate, calcium linolate, cadmium linolate and the like, may be used. Also, colloidal silica calcined at high temperatures may be used, and further, natural wax, such as carnauba wax may be used.

The photoconductor 201 whose friction coefficient is set in the aforementioned range is charged to a predetermined surface potential before use by the charging device 202. Then, the electrostatic latent image-forming device 203 forms an electrostatic latent image on the charged photoconductor 201 by an optical writing operation. After the electrostatic latent image is formed, toner borne on the developing roller 205 visualizes the electrostatic latent image to a visible toner image. At this time, the photoconductor 201 and the developing roller 205 contacts with each other via a toner layer formed on the developing roller 205.

In order to press the developing roller 205 to the photoconductor 201, the pressing device 209 is provided between a rear side (right side in FIG. 8) of the developing unit 204*a* and the main body frame 210 of the image forming apparatus as described before. The pressing device 209 contacts the developing unit 204*a* that includes the developing roller 205, when pressing the developing roller 205 to the photoconductor 201, and pressure is obtained by an elastic force of the pressing device 209. The developing roller 205 is made of, for example, silicone rubber having a JIS A hardness of 30° and the pressing device 209 in also made of silicone rubber having a JIS A hardness of 10°, which is no greater than the hardness of the developing roller 205.

When a contacting condition of the developing roller 205 to the photoconductor 201 is set according to a distance between shafts of the photoconductor 201 and the developing roller 205, as in prior art contact developing systems, a contact pressure of the developing roller 205 to the photoconductor 201 varies when the circularity of the surface of the developing roller 205 is not uniform, because the distance between the shafts of the photoconductor 201 and the developing roller 205 are fixedly secured at a constant distance. This causes an unevenness in image density of a developed image. However, because the hardness (elastic modulus) of the pressing device 209 is smaller than that of the developing roller 205, when the contact pressure of the developing roller 205 to the photoconductor 201 varies as above, the pressing device 209 is compressed and therefore, a fluctuation of the contact pressure is absorbed so that the contact pressure of the developing roller 205 to the photoconductor 201 does not fluctuate. When the radius of the part of the developing roller 205 is 0.05 mm greater than the designed radius thereof, the increased amount of the contact pressure of the developing roller 205 to the photoconductor 201 is 4.8 g/mm. However, even when the contact pressure is thus increased, the pressing device 209 is compressed to absorb the aforementioned increased contact pressure, and the increase of the contact pressure is decreased to about 1.8 g/mm. Thus, the fluctuation of the contact pressure of the developing roller 205 to the photoconductor 201 can be decreased and an unevenness of image density hardly occurs.

In addition, the fluctuation of the contact pressure of the developing roller 205 to the photoconductor 201 can be decreased without increasing the contact pressure of the developing roller 205 to the photoconductor 201 as in the background art. Therefore, an image having a lateral streaks that may periodically occur due to an unevenness of a moving speed of the rotating surface of the photoconductor 201, hardly occurs.

Furthermore, when the surface layer of the developing roller 205, which is made of elastic material, receives a stress of relatively high contact pressure, a permanent deformation may occur in the developing roller 205 and the operable life of the developing roller 205 may be decreased. Accordingly, it is advantageous to decrease the contact pressure of the developing roller 205 to the surface of the photoconductor 201.

In the embodiment, the developing roller 205 has the JIS A hardness of 30°, and a preferable contact pressure of the developing roller 205 to the photoconductor 201 is in a range of 3 to 8 g·f/cm. When the contact pressure of the developing roller 205 to the photoconductor 201 falls below lower limit of a certain range as described above, the developing performance fluctuates resulting in insufficient developing. When the contact pressure of the developing roller 205 to the photoconductor 201 exceeds an upper limit of the range, the scavenging force of toner increases and the toner once moved to the photoconductor 201 in the developing operation moves back to the developing roller 205, and the toner is coagulated by the contact pressure of the developing roller 205 to the photoconductor 201. Accordingly, an abnormal image having, for example, an uneven density in a solid portion of the image easily occurs.

However, when the contact pressure of the developing roller 205 to the photoconductor 201 remains in the aforementioned preferable range, the above-mentioned shortcomings do not occur and an image having a uniform density can be formed on the photoconductor 201.

Sixth Embodiment

FIG. 9 is a schematic drawing illustrating a developing section of an image forming apparatus according to the sixth embodiment of the present invention, as viewed from upward. The construction of the image forming apparatus is substantially the same as that illustrated in FIG. 8, and only parts relating to the developing roller 205 and the developing unit 204*a* of the developing device 204 are illustrated so as to simplify the drawing.

As illustrated in FIG. 9, a plurality of pressing devices 209 (two pressing devices 209 are provided in FIG. 9 for example) are provided between a rear side (right side in FIG. 8) of the developing unit 204*a* and the main body frame 210 of the image forming apparatus. The developing unit 204*a* are pressed by the pressing device 209 at two parts thereof so as to cause the developing roller 205 to contact the photoconductor 201. If only one pressing device 201 is provided, for example, at the center part of the developing unit 204*a*, the pressure applied to the developing roller 205 via the developing unit 204*a* may not be evenly distributed in a longitudinal direction (parallel to the shaft direction) to both ends of the developing roller 205.

In addition, when the developing roller 205 has a difference in the dimension of the outer diameter at the both ends of the developing roller, the contact pressure of the developing roller 205 to the photoconductor 201 at the both ends thereof cannot be equal, and thereby, an unevenness of the image density may be caused in the longitudinal direction of the photoconductor 201.

However, when the developing roller 205 is pressed by the two pressing devices 209 at appropriately separated two portions in the longitudinal direction of the developing roller 205 through the developing unit 204*a,* as illustrated in FIG. 9, a good balance of pressing force in the longitudinal direction of the developing roller 205 can be obtained, and thereby the influence of the difference between the outer diameters of both ends of the developing roller 205 can be avoided and the developing roller 205 evenly contacts the photoconductor 201. As a result, an image having a uniform density can be obtained.

Seventh Embodiment

FIG. 10 is a schematic drawing illustrating an exemplary construction of a main part of a developing device of an image forming apparatus according to the seventh embodiment of the present invention, as viewed from upward. The construction of the image forming apparatus is substantially the same as that in FIG. 8, and only parts relating to the developing roller 205 and the developing unit 204*a* of the developing device 204 are illustrated so as to simplify the drawing.

In the embodiment, a coil spring is used as the pressing device 209 that biases a tension force to the developing roller 205. The coil spring is provided between the frames 217 that support both end portions of the shaft of the photoconductor 201 and both side portions of the developing unit 204*a*. By pulling both side portions of the developing unit 204*a* toward the photoconductor 201 by the pressing device 209 composed of the coil spring, the developing roller 205 can be evenly pressed to the photoconductor 201 and a uniform contact pressing force can be obtained.

Further, an elastic modulus of the coil spring can be widely selected by changing a length and a wire diameter of the coil spring. In addition, the coil spring (in particular, a metal spring) is tough and a stable pressure can be a long elapse of time. Further, the coil spring is inexpensive and therefore low manufacturing cost can be realized.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus, comprising:

a latent image bearing member configured to bear an electrostatic latent image; and a developer bearing member configured to bear a developer; and wherein the electrostatic latent image is formed on the latent image bearing member by first uniformly charging the latent image bearing member and then by performing an optical writing operation, and the electrostatic latent image is visualized by supplying the developer borne on the developer bearing member to the latent image bearing member, and wherein a lubricant configured to reduce a coefficient of friction of a surface of the latent image bearing member is supplied to the latent image bearing member and the lubricant has a charging polarity opposite to that of the developer.

2. The image forming apparatus according to claim 1, wherein the coefficient of friction of the surface of the latent image bearing member is maintained such that adhering of the developer to a background part of the latent image is prevented as a result of supplying the lubricant to the latent image bearing member.

3. The image forming apparatus according to claim 1, wherein the lubricant is supplied to the latent image bearing member such that the friction coefficient of the surface of the latent image bearing member is from about 0.1 to about 0.4.

4. The image forming apparatus according to claim 1, wherein the lubricant comprises a silicone resin.

5. The image forming apparatus according to claim 1, wherein the coefficient of friction of the surface of the latent image bearing member is set such that a cleaning device configured to remove a residual developer on the surface of the latent image bearing member is prevented from being dragged by the latent image bearing member by decreasing a contact resistance between the cleaning device and the surface of the latent image bearing member.

6. The image forming apparatus according to claim 1, wherein the latent image on the latent image bearing member is visualized by contacting the developer, having a same polarity as the charged part of the latent image bearing member to a part of the latent image bearing member where the charge is decayed by the optical writing operation.

7. The image forming apparatus according to claim 1, wherein the developer is a one-component developer.

8. An image forming apparatus, comprising:

a latent image bearing member configured to bear an electrostatic latent image; and a developer bearing member configured to bear a developer; and wherein the electrostatic latent image is formed on the latent image bearing member by first uniformly charging the latent image bearing member and then by performing an optical writing operation, the latent image is visualized by supplying the developer borne on the developer bearing member to the latent image bearing member, the visualized image is transferred onto a transfer sheet, and the transferred image is fixed onto the transfer sheet, and wherein a lubricant configured to reduce a friction coefficient of a surface of the latent image bearing member is supplied, and the lubricant has a charging polarity opposite to that of the latent image bearing member.

9. The image forming apparatus according to claim 8, wherein the lubricant comprises a silicone resin.

10. The image forming apparatus according to claim 8, wherein the electrostatic latent image on the latent image bearing member is visualized by contacting the developer borne on a surface of the developer bearing member to the latent image bearing member.

11. An image forming apparatus, comprising:

a latent image bearing member having a surface whose friction coefficient is set from about 0.1 to about 0.4; and a developer bearing member configured to bear a developer; and wherein an electrostatic latent image is formed by performing an optical writing operation to the latent image bearing member after the latent image bearing member is uniformly charged, the electrostatic latent image on the latent image bearing member is developed to be a toner image by contacting the latent image bearing member to the developer bearing member, and the toner image is transferred to a recording medium, wherein a lubricant is applied to the latent image bearing member so as to decrease a friction coefficient of a surface of the latent image bearing member and at least one of additive is added to the developer, and wherein the at least one of additive that is added to the developer has a charged polarity opposite to that of the lubricant existing on the surface of the latent image bearing member.

12. The image forming apparatus according to claim 11, further comprising:

a developer supplying member configured to supply the developer to the developer bearing member by contacting the developer bearing member and rotating in one of a same direction and a reverse direction relative to a rotating direction of the developer bearing member; and wherein a linear speed of a surface of the developer supplying member is from about 0.5 to about 1.5 times that of the developer bearing member; and wherein an intruding amount of one of the developer supplying member to the developer bearing member, and the developer bearing member to the developer supplying member, is from about 0.5 mm to about 1.5 mm.

13. The image forming apparatus according to claim 11, wherein the developer comprises a toner having an average particle diameter of from about 3 μm to about 12 μm.

14. The image forming apparatus according to claim 11, wherein a particle diameter of the developer is from about 4 μm to about 6 μm.

15. The image forming apparatus according to claim 11, wherein a surface roughness of the developer bearing member is made to be from about 13% to about 80% of a toner particle diameter of the developer.

16. The image forming apparatus according to claim 11, wherein a surface of the developer bearing member is coated with a silicone coating material.

17. The image forming apparatus according to claim 11, wherein a surface of the developer bearing member is coated with a Teflon coating material.

18. The image forming apparatus according to claim 11, wherein a surface of the developer bearing member is coated with a coating material and a thickness of a coated layer on the developer bearing member is from about 5 μm to about 50 μm.

19. The image forming apparatus according to claim 11, further comprising:

a developer limiting member configured to limit a thickness of a layer of the developer borne on the developer bearing member; and a holder configured to hold the developer limiting member, wherein a length of a part of the developer limiting member protruding from the holder is from about 10 mm to about 15 mm.

20. The image forming apparatus according to claim 11, further comprising:

a developer limiting member configured to limit a thickness of a layer of the developer borne on the developer bearing member, wherein a contact pressure of the developer limiting member to the developer bearing member is from about 5 g·f/cm to about 250 g·f/cm.

21. The image forming apparatus according to claim 11, further comprising a pressing device configured to contact the developer bearing member to the latent image bearing member.

22. The image forming apparatus according to claim 21, wherein the pressing device includes a plurality of members configured to contact the developer bearing member to the latent image bearing member.

23. An image forming apparatus, comprising:

a latent image bearing member having a surface with a friction coefficient set so as to be from about 0.1 to about 0.4; and a developer bearing member configured to bear a developer;

wherein an electrostatic latent image is formed by performing an optical writing operation to the latent image bearing member after the latent image bearing member is uniformly charged, the electrostatic latent image on the latent image bearing member is developed to a toner image by contacting the latent image bearing member to the developer bearing member, and the toner image is transferred to a recording medium;

wherein a lubricant is applied to the latent image bearing member so as to decrease a friction coefficient of a surface of the latent image bearing member and at least two additives are added to the developer; and wherein one of the at least two additives that are added to the developer has a charged polarity opposite to that of the lubricant existing on a surface of the latent image bearing member and the other one of the at least two additives has a same charged polarity as that of the lubricant existing on the surface of the latent image bearing member, and an addition amount of the one of the at least two additives is two or more times an addition amount of the other one of the at least two additives by a surface area ratio.

24. An image forming apparatus, comprising:

a latent image bearing member having a surface having a coefficient of friction from about 0.1 to about 0.4; and a developer bearing member configured to bear a developer; and wherein an electrostatic latent image is formed by performing an optical writing operation to the latent image bearing member after the latent image bearing member is uniformly charged, the electrostatic latent image on the latent image bearing member is developed to a toner image by contacting the latent image bearing member to the developer bearing member, and a coagulation rate of the developer is equal to or more than 15%.

25. The image forming apparatus according to claim 24, wherein the friction coefficient of the surface of the latent image bearing member is greater than 0.1 and smaller than 0.2.

26. A method for forming an image with an image forming apparatus, comprising the steps of:

uniformly charging a latent image bearing member having a surface having a coefficient of friction from about 0.1 to about 0.4;

forming an electrostatic latent image on the latent image bearing member by performing an optical writing operation;

forming a toner image by developing the electrostatic latent image on the latent image bearing member by contacting the latent image bearing member bearing the electrostatic latent image formed thereupon to a developer bearing member bearing a developer;

transferring the toner image to a recording medium; and adding at least one additive to the developer, said at least one additive having a charged polarity opposite to that of a lubricant existing on a surface of the image bearing member.

27. A method for forming an image with an image forming apparatus, comprising the steps of:

uniformly charging a latent image bearing member having a surface having a coefficient of friction from about 0.1 to about 0.4;

forming an electrostatic latent image on the latent image bearing member by performing an optical writing operation;

forming a toner image by developing the electrostatic latent image on the latent image bearing member by contacting the latent image bearing member bearing the electrostatic latent image formed thereupon to a developer bearing member bearing a developer having a coagulation rate equal to or more than 15%; and transferring the toner image to a recording medium.

* * * * *